US008894355B2

(12) United States Patent
Sekita et al.

(10) Patent No.: US 8,894,355 B2
(45) Date of Patent: Nov. 25, 2014

(54) TURBOMOLECULAR PUMP, AND PARTICLE TRAP FOR TURBOMOLECULAR PUMP

(75) Inventors: Yukiteru Sekita, Kyoto (JP); Kazuma Kubota, Kyoto (JP); Tsuyoshi Moriya, Tokyo (JP); Eiichi Sugawara, Nirasaki (JP)

(73) Assignees: Shimadzu Corporation, Kyoto-shi (JP); Tokyo Electron Limited, Tokyo (JP)

( * ) Notice: Subject to any disclaimer, the term of this patent is extended or adjusted under 35 U.S.C. 154(b) by 629 days.

(21) Appl. No.: 13/146,497

(22) PCT Filed: Feb. 5, 2010

(86) PCT No.: PCT/JP2010/051686

§ 371 (c)(1),
(2), (4) Date: Jul. 27, 2011

(87) PCT Pub. No.: WO2010/098192

PCT Pub. Date: Sep. 2, 2010

(65) Prior Publication Data

US 2011/0293401 A1 Dec. 1, 2011

(30) Foreign Application Priority Data

Feb. 24, 2009 (JP) ..... 2009-041318
Nov. 2, 2009 (JP) ..... 2009-251801

(51) Int. Cl.
*F04D 19/04* (2006.01)
*F04D 29/70* (2006.01)

(52) U.S. Cl.
CPC ..... *F04D 29/701* (2013.01); *F04D 19/042* (2013.01)
USPC ..... 415/121.2

(58) Field of Classification Search
CPC ..... F04D 5/007; F04D 19/042; F04D 29/701
USPC ..... 415/55.1, 121.1, 168.1
See application file for complete search history.

(56) References Cited

U.S. PATENT DOCUMENTS 5,528,618 A * 6/1996 Schlie et al. ..... 372/58
7,837,432 B2 * 11/2010 Moriya et al. ..... 415/90

(Continued)

FOREIGN PATENT DOCUMENTS

CN 1039287 A 1/1990
JP 2001-059496 A 3/2001

(Continued)

OTHER PUBLICATIONS

International Search Report for PCT/JP2010/051686, mailing date of Apr. 20, 2010.

*Primary Examiner* — Edward Look
*Assistant Examiner* — Jeffrey A Brownson
(74) *Attorney, Agent, or Firm* — Westerman, Hattori, Daniels & Adrian, LLP

(57) ABSTRACT

A turbomolecular pump includes: a rotor (30) formed with rotating blades (32) in a plurality of stages, and rotating at high speed; a plurality of fixed blades (33) arranged along axial direction of the pump so as to alternate with respect to the rotating blades (32); a pump housing (34) containing the rotating blades (32) and the fixed blades (33), and formed with an inlet opening (21*a*); a circular disk (150), provided close to the inlet opening of the rotor (30), and arranged so as to oppose a surface of the rotor (30) radially inward than a root portion of the rotating blades; and a cylindrical mesh structure (153*a*, 153*b*), disposed between the inlet opening (21*a*) and the rotor (30), and made by interlacing fine wires. Particles that strike the rotor and bounce off are captured internally in the mesh structure (153*a*, 153*b*).

12 Claims, 13 Drawing Sheets

(56) References Cited

U.S. PATENT DOCUMENTS

| | | | | |
|---|---|---|---|---|
| 2003/0017047 | A1* | 1/2003 | Shiokawa et al. | 415/90 |
| 2008/0240905 | A1 | 10/2008 | Sugawara et al. | |
| 2009/0008369 | A1 | 1/2009 | Nozawa et al. | |
| 2010/0290915 | A1 | 11/2010 | Englaender | |

FOREIGN PATENT DOCUMENTS

| | | | |
|---|---|---|---|
| JP | 2004-278500 | A | 10/2004 |
| JP | 2005-344512 | A | 12/2005 |
| JP | 2006-307823 | A | 11/2006 |
| JP | 2007-180467 | A | 7/2007 |
| JP | 2007-211696 | A | 8/2007 |
| JP | 2008-240701 | A | 10/2008 |
| KR | 2001-0007349 | A | 1/2001 |
| TW | 475034 | B | 2/2002 |
| TW | 200805491 | A | 1/2008 |
| TW | 200925431 | A | 6/2009 |

* cited by examiner (a)

(b)

(a)

(b)

(a)

(b)

TURBOMOLECULAR PUMP, AND PARTICLE TRAP FOR TURBOMOLECULAR PUMP

TECHNICAL FIELD

The present invention relates to a turbomolecular pump, and to a particle trap for a turbomolecular pump.

BACKGROUND ART

A turbomolecular pump is used in an etching process such as semiconductor production or the like, or in a CVD process. When particles of a reaction product or the like flow into the turbomolecular pump from a vacuum chamber that is used in those processes, these particles are struck by the rotor that is rotating at high speed and bounce off it, and sometimes it happens that these recoil particles get as far as the vacuum chamber. As a result, there is the problem that the recoil particles adhere upon the wafer, and cause the yield rate of semiconductor production to be deteriorated.

As a structure for reducing this type of reverse flow of recoil particles to the vacuum chamber, structures like those proposed in Patent Documents #1 through #3 have been proposed. In Patent Document #1, a small chamber for capturing particles is provided at the inner peripheral surface of the pump casing, and particles are struck by the rotating blades and bounce off in the direction of this small chamber. And, in Patent Document #2, within the pump casing, it is arranged to provide a capture member made from a rubber material, a sponge material, a cotton material or the like, or a shock absorption member whose coefficient of restitution is small. Furthermore, in Patent Document #3, a flocculent mass made from stainless steel felt or a fluoroplastic resin felt is provided as a particle capture mechanism.

CITATION LIST

Patent Literature

Patent Document #1: Japanese Laid-Open Patent Publication 2006-307823;

Patent Document #2: Japanese Laid-Open Patent Publication 2007-211696;

Patent Document #3: Japanese Laid-Open Patent Publication 2007-180467.

SUMMARY OF INVENTION

Technical Problem

However there is the problem that, with a small chamber or a capture member such as a rubber material, a sponge material, a cotton material, or felt or the like, it is not possible to perform sufficient trapping of the particles. Moreover, with the structure described in Patent Document #3, since the circular plate shaped capture member is provided in the neighborhood of the inlet opening, accordingly there is the shortcoming that the reduction in the evacuation speed due to the provision of the capture member is great.

Solution to Problem

A turbomolecular pump, according to the 1st aspect of the present invention, comprises: a rotor formed with rotating blades in a plurality of stages, and rotating at high speed; a plurality of fixed blades arranged along axial direction of the pump so as to alternate with respect to the rotating blades; a pump housing containing the rotating blades and the fixed blades, and formed with an inlet opening; a circular disk, provided close to the rotor on the inlet opening side, and arranged so as to oppose a surface on the rotor more radially inward than a root portion of the rotating blades; and a cylindrical mesh structure, disposed between the inlet opening and the rotor, and made by interlacing thin wires; wherein particles that are struck by the rotor and bounce off it are captured internally in the mesh structure.

It should be noted that the turbomolecular pump may comprise a plurality of plate shaped mesh structures disposed so as to extend radially with respect to the cylindrical mesh structure, and provided perpendicularly to the pump inlet opening.

A turbomolecular pump, according to the 2nd aspect of the present invention, comprises: a rotor formed with rotating blades in a plurality of stages, and rotating at high speed; a plurality of fixed blades arranged along axial direction of the pump so as to alternate with respect to the rotating blades; a pump housing containing the rotating blades and the fixed blades, and formed with an inlet opening; a circular disk, provided close to the rotor on the inlet opening side, and arranged so as to oppose a surface on the rotor more radially inward than a root portion of the rotating blades; and a mesh structure, provided along the pump housing inner wall, and made by interlacing fine wires.

It should be noted that the turbomolecular pump may comprise a protective net provided that prevents ingress of foreign matter into the pump housing via the inlet opening, including the circular disk, and a net region that is provided to the protective net so as to surround the circular disk and in which a plurality of apertures are formed. It should also be noted that the mesh structure may be made by arranging a fabric type net made by interlacing fine wires in a layered structure. It should further be noted that the fine wires may be made from stainless steel, or from alumina-silica fiber containing 6 to 10% silica.

A turbomolecular pump, according to the 3rd aspect of the present invention, comprises: a casing that comprises a first flange connected to a flange of an inlet opening of the turbomolecular pump and a second flange that is connected to a flange of an outlet opening of a vacuum device; and a cylindrical mesh structure, disposed in the casing interior, and made by interlacing fine wires so as to capture in its interior particles that have been struck by a rotor of the turbomolecular pump and have bounced off it.

It should be noted that the turbomolecular pump may comprise a circular disk disposed near the first flange so as to face the rotor upper surface of the turbomolecular pump, and whose diametrical dimension is less than or equal to a diameter of a root portion of rotating blades of the rotor of the turbomolecular pump.

It should also be noted that the turbomolecular pump may comprise a protective net having a circular region whose diametrical dimension is less than or equal to the diameter of a root portion of rotating blades of the rotor of the turbomolecular pump and a net region that is provided so as to surround a periphery of the circular region and in which a plurality of apertures are formed, and that prevents ingress of foreign matter into the turbomolecular pump via the flange of the inlet opening flange.

It should further be noted that the turbomolecular pump further comprises a plurality of plate shaped mesh structures disposed so as to extend radially with respect to the cylindrical mesh structure, and provided along axial direction of the first and second flanges.

It should yet further be noted that the fine wires may be made from stainless steel, or from alumina-silica fiber containing 6 to 10% silica.

Advantageous Effect of Invention

According to the present invention, it is possible to provide a turbomolecular pump in which reverse flow of recoil particles is prevented, along with decrease of the evacuation speed being restrained.

BRIEF DESCRIPTION OF DRAWINGS

FIG. 6(*a*) is an exploded perspective view of the mesh structure 153, and FIG. 6(*b*) is a figure showing a mesh 155;

FIG. 7(*a*) shows a first variant embodiment, and FIG. 7(*b*) shows a second variant embodiment;

FIG. 8(*a*) shows a case in which the mesh structure 153 is provide to a baffle, and FIG. 8(*b*) shows a case in which the mesh structure 153 is provided to the inner peripheral surface of the pump casing 34;

DESCRIPTION OF EMBODIMENTS

In the following, preferred modes for implementation of the invention will be explained with reference to the drawings.

—First Embodiment—

Figure 1:
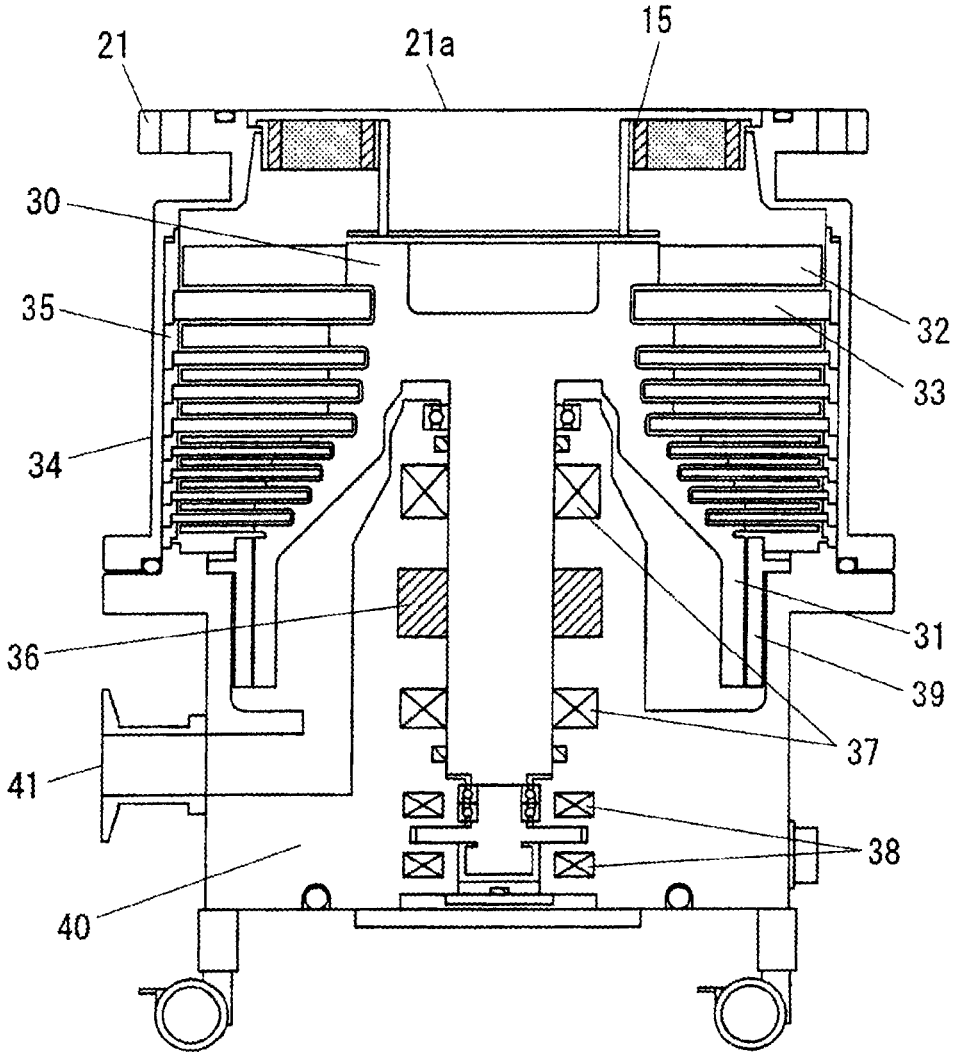
FIG. 1 is a sectional view showing the general structure of a turbomolecular pump according to the present invention.

FIG. 1 is a sectional view showing the general structure of a turbomolecular pump according to the present invention. A rotor 30 is provided so as to rotate freely within a pump casing 34. The turbomolecular pump 10 shown in FIG. 1 is a magnetic bearing type pump, and the rotor 30 is supported in a non contact manner by electromagnets 37 and 38 that constitute a five axis magnetic bearing. The rotor 30 is magnetically levitated by this magnetic bearing, and is rotationally driven at high speed by a motor 36.

The rotor 30 includes a number of stages of rotating blades 32, and a cylindrical screw rotor 31. On the other hand, on the fixed side, there are provided a number of stages of fixed blades 33 arranged alternately with the rotating blades 32 along the axial direction, and a screw stator 39 that is provided radially outward of the screw rotor 31. Each of the fixed blades 33 is mounted to a base 40 via a spacer ring 35. When a pump casing 34 on which an inlet opening flange 21 is formed is fixed to the base 40, the layered together spacer rings 35 are sandwiched between the base 40 and the pump casing 34, and thereby the positions of the fixed blades 33 are determined.

An outlet port is provided to the base 40, and a back pump is connected to this outlet port 41. Due to the rotor 30 being rotationally driven at high speed by the motor 36 while being magnetically levitated, gas molecules at the inlet opening 21*a* are evacuated toward the outlet port 41.

Figure 2:
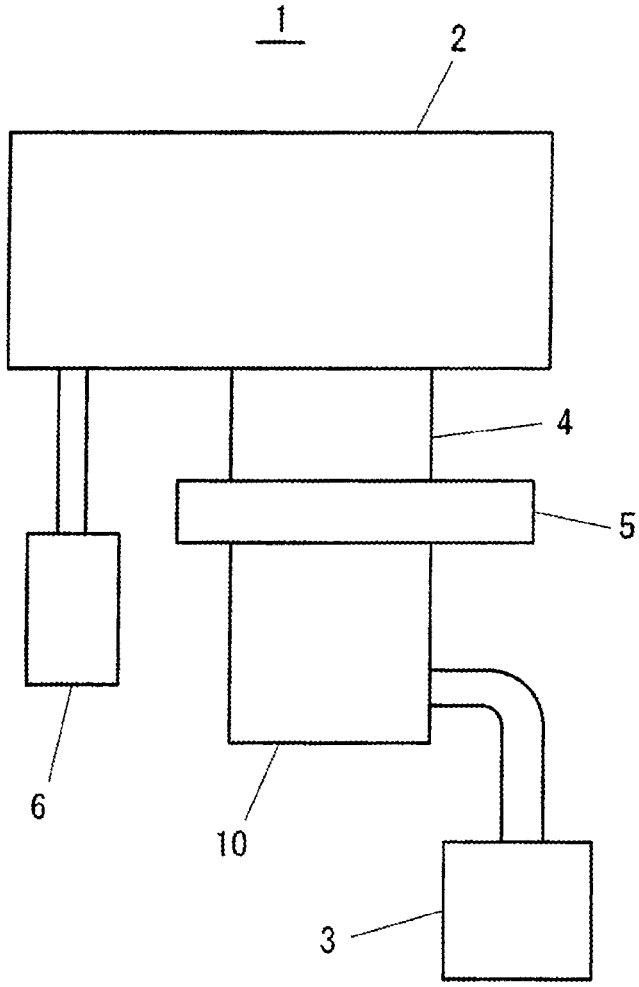
FIG. 2 is a figure showing the general structure of a CVD layer formation device that is provided with such a turbomolecular pump 10.

FIG. 2 is a figure showing an example of a semiconductor manufacturing device to which the turbomolecular pump 10 is mounted, and shows the general structure of a CVD film formation device. The turbomolecular pump 10 is installed via a gate valve 5 to an outlet port 4 that is provided at the lower portion of a process chamber 2. A process gas is supplied from a gas supply unit 6 to the process chamber 2.

With this film formation device, a large number of particles of the sub-micrometer order of size are created due to chemical reactions during the film formation process and due to sliding of mechanical parts and so on. When these particles flow via the inlet opening 21*a* into the turbomolecular pump 10, they are struck by the rotor that is rotating at high speed and bounce off it. As described above, when these recoil particles arrive at the process chamber, they adhere to the wafer, and this constitutes a cause for deterioration of the semiconductor production yield rate.

In order to reduce the negative influence of this type of recoil particles upon semiconductor production, with the turbomolecular pump of this embodiment, a baffle 15 is provided within the pump casing 34, and includes a mechanism that captures the particles that have flowed in through the inlet opening 21*a* before they can be incident upon the rotor, and a mechanism that captures the recoil particles that have struck the rotor and bounced off it.

Figure 3:
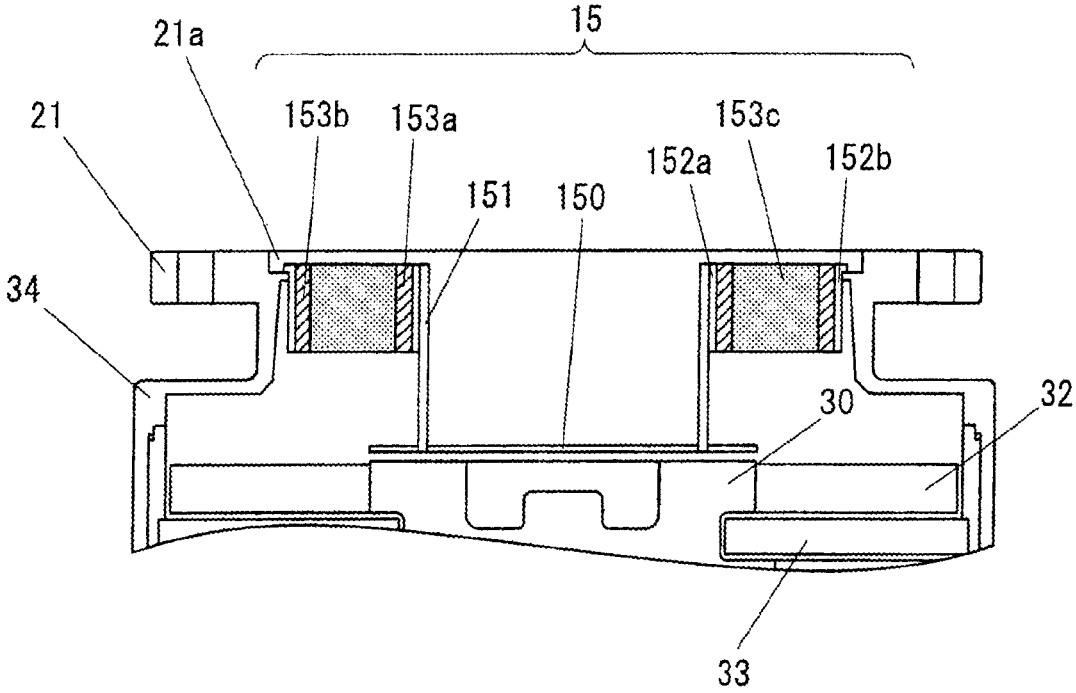
FIG. 3 is an enlarged view of a portion of the turbomolecular pump to which a baffle 15 is provided.
Figure 4:
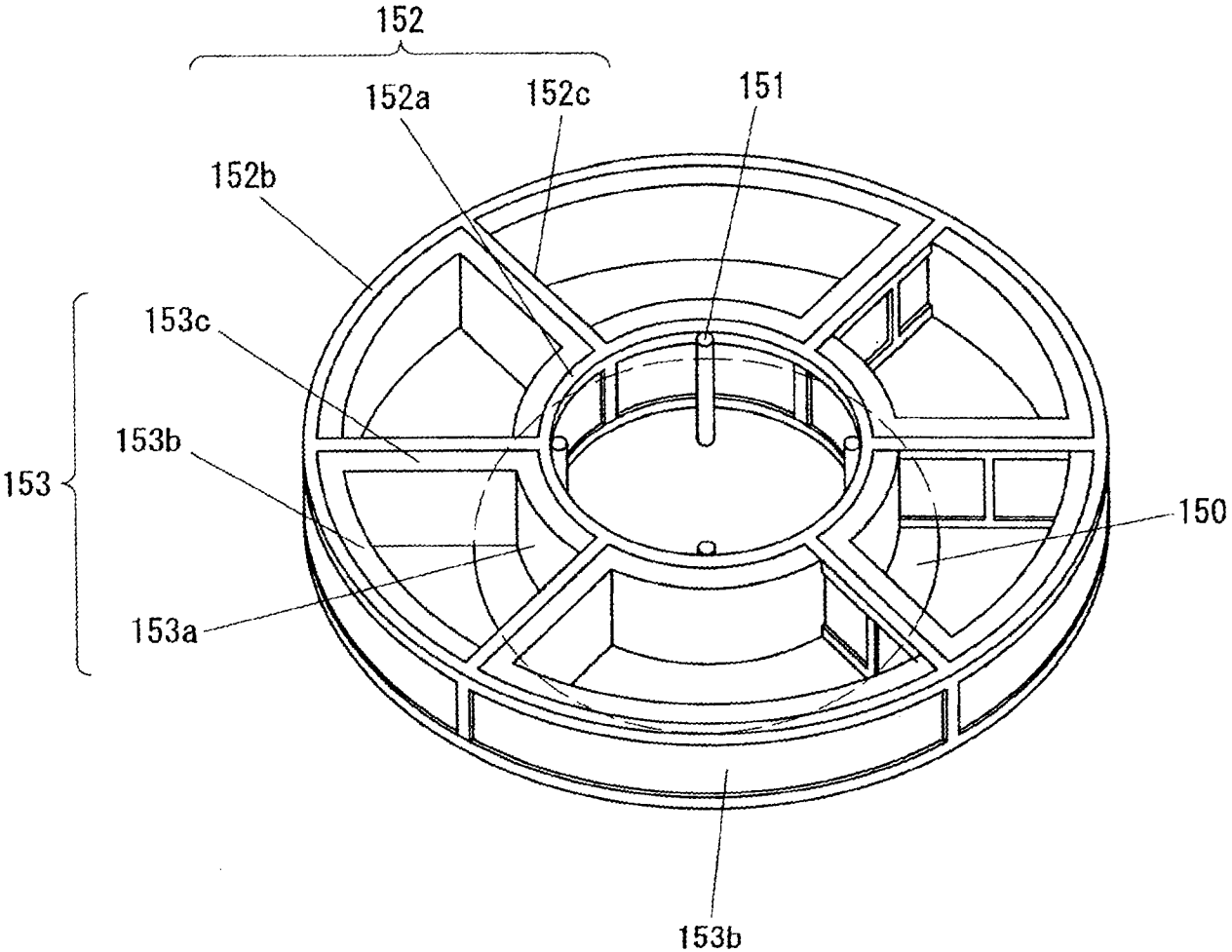
FIG. 4 is a perspective view of the baffle 15.

FIG. 3 and FIG. 4 are figures for explanation of the baffle 15. FIG. 3 is an enlarged view of the portion to which the baffle 15 of FIG. 1 is provided. And FIG. 4 is a perspective view of the baffle 15. The baffle 15 is attached to the flange 21 of the pump casing 34. As shown in FIG. 4, the baffle 15 includes a circular disk 150, struts 151, a frame 152, and a mesh structure 153.The frame 152 has a ribbed structure, and includes an inner ring 152*a*, an outer ring 152*b*, and radially extending ribs 152*c* that connect the rings 152*a* and 152*b*.

The plurality of struts 151 are fixed at regular intervals to the inner circumferential surface of the inner ring 152*a*, and, at its lower end, each of these struts 151 is fixed to the circular disk 150. As shown in FIG. 3, the length of the struts 151 is set so that the circular disk 150 is positioned in the neighborhood of the upper surface of the rotor 30. Although the rotor 30 rotates at high speed while being magnetically levitated, it moves slightly up and down in the axial direction according to the gas loading. Due to this, the circular disk 150 is located in a position such that it does not contact the rotor 30, even though the rotor 30 shifts somewhat up and down. Moreover, the external diametrical dimension of the circular disk 150 is set to be less than or equal to the diametrical dimension of the base mounting portions of the rotating blades 32, so that the circular disk 150 does not block the rotating blades 32 from above.

As shown by the reference symbols 153*a* through 153*c*, the plate shaped mesh structure 153 is provided so as to cover the outer circumferential surface of the inner ring 152*a*, the inner circumferential surface of the outer ring 152*b*, and the surfaces of the radially extending ribs 152*c* on one side. It should be understood that the configuration of the mesh structure

153*c* shown in FIG. 4 is applicable to the case in which the rotor 30 rotates in the clockwise direction as seen from the inlet opening. In the case of a structure in which the rotor 30 rotates in the anticlockwise direction, it is desirable for the mesh structure 153*c* to be mounted so that the surface on the opposite side of the radially extending ribs 152*c* is covered.

Figure 5:
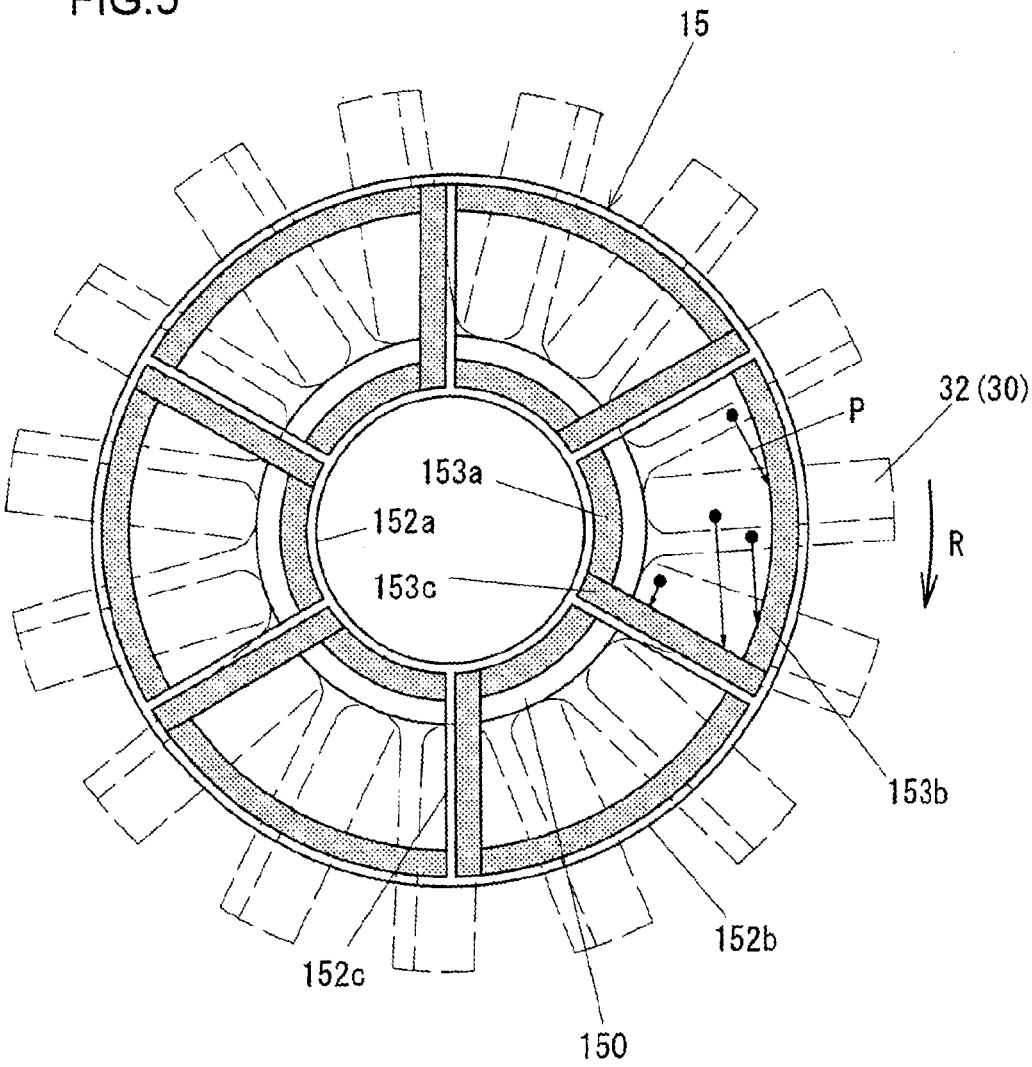
FIG. 5 is a figure showing the baffle 15 as seen from the inlet opening.

FIG. 5 shows the baffle 15 as seen from the inlet opening. The broken lines show the first stage of rotating blades 32 of the rotor 30. Particles that fall down into the pump from the inlet opening 21*a* and that pass through the baffle 15 either fall down upon the circular disk 150 at its central portion, or fall down upon the rotating blades 32 further radially outwards than the circular disk 150. Since the particles that fall down upon the circular disk 150 stay upon the circular disk, they do not return towards the device.

On the other hand, particles that fall down upon the rotating blades 32 are struck by the rotating blades 32 that are rotating at high speed, and bounce off them. In FIG. 5, the rotating blades 32 are rotating in the clockwise direction, as shown by the arrow R. Since particles that fall down upon the rotating blades 32 receive force in the direction of the tangential line, the tendency for them to bounce off in the tangential line direction is great. In FIG. 5, some tracks P when particles have simply bounced off in directions of tangential lines are shown. Since the recoil particles bounce off along the directions of tangential lines in this manner, accordingly it is considered that more of them will be incident upon the mesh structure 153*b* at the external circumference.

As will be described hereinafter, the mesh structure 153 is made by interlacing thin wires such as metallic wires or the like, and the size of its meshes is larger than the size of the particles. Due to this, while some of the recoil particles that are incident upon the mesh structure 153 bounce back from the surfaces of its wires, the greater portion enter into its internal structure, and then repeatedly collide with wires in its interior. Due to these repeated collisions, the kinetic energy of the recoil particles becomes smaller, so that finally they come to be captured in the interior of the mesh structure 153.

Figure 6:
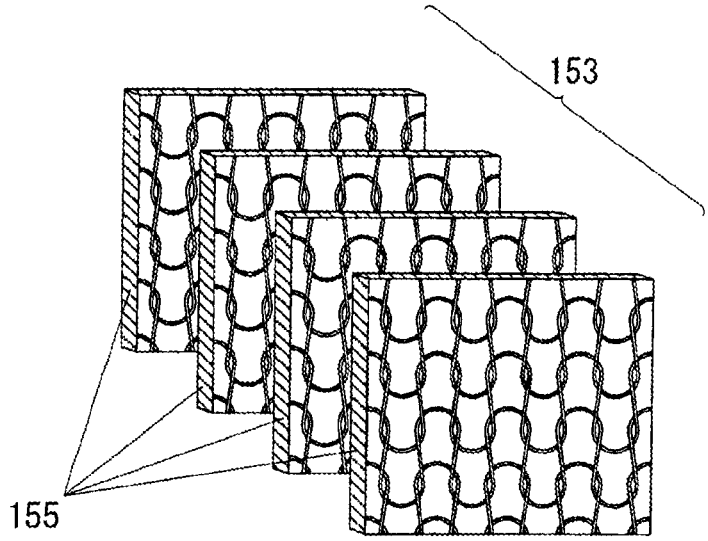
FIG. 6 is a figure for explanation of a mesh structure 153 having a laminated construction.
Figure 6:
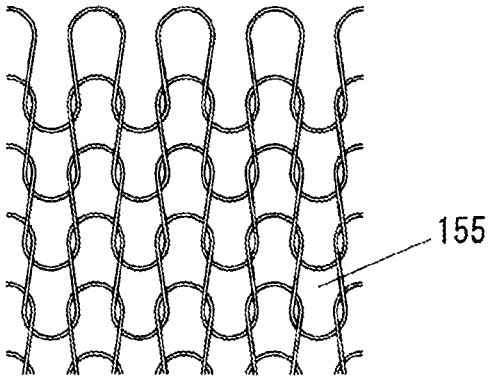

FIG. 6(*a*) shows an example of the mesh structure 153. For this mesh structure, for example, a fabric type net 155 made from mesh springs may be used, as described in Japanese Laid-Open Patent Publication 2006-132741. As shown in FIG. 6(*b*), this mesh 155 is made by knitting together fine metallic wires such as stainless steel wires or the like with a knitting machine. It should be understood that it would also be acceptable to squeeze such a knitted net between crimping rollers so as to make it wavy, and to use this crimped material for the net 153. Instead of a net of fine metallic wires, it would also be acceptable to employ a fabric type material that is made by interlacing alumina-silica fibers made from alumina and silica. In this case it is desirable for the ratio of silica to be 6 to 10%, in order to obtain adequate flexibility. Moreover, the process for interlacing together the fine metallic wires is not to be considered as being limited to knitting; it would also be acceptable for this to be performed by plain weaving or the like.

Since the mesh structure 153 of this embodiments is made as the net 155 in which metallic wires or the like are interlaced, accordingly the gaps between the metallic fibers are large, as compared with a prior art capture member in which the metallic fibers are formed as a felt. Due to this, the recoil particles can easily enter into the interior of the mesh structure 153, and are reliably captured.

On the other hand, in the case of a capture member that is formed from a felt, the structure becomes tight as compared with the mesh 155 because the felt is made by compression of short fibers, and it is difficult for the recoil particles to get into the interior of this capture member. Due to this, it becomes difficult for high speed recoil particles to undergo a sufficient number of collisions to lose their kinetic energy, so that the capture ratio becomes inferior as compared to the mesh structure 153. As a result, particles that have not been captured are struck by the rotor 30 for a second time and bounce off it, and, in this repeated recoiling, may flow in reverse from the inlet opening 21*a* back to the process chamber. In other words, with this prior art structure that is inferior in capture ratio, the probability becomes high that recoil particles may flow in reverse into the process chamber.

It should be understood that in this embodiment it is made easy for the recoil particles to enter into the interior of the mesh structure 153, since the coarse net 155 is made in a laminated construction. In this case, it would be acceptable to make all the layers from the same mesh material; or it would also be acceptable to vary the roughness of the mesh according to the layer, by making the meshes that are close to the surface coarse, while making the meshes for the internal layers in which the particles are captured somewhat finer. Moreover, if a comparatively flat mesh such as a metallic mesh or the like is to be laminated, it is desirable to crinkle the metallic mesh and thus bulk up the material to be laminated, so as to make it easy for the recoil particles to enter into the interior of the mesh.

Furthermore, the circular disk 150 is provided in order to prevent particles from being struck by the upper surface of the rotor 30 (i.e. the portion thereof other than the rotating blades) and bouncing off it. Since, in this embodiment, the circular disk 150 is located in the vicinity of the upper surface of the rotor 30, accordingly there is almost no difference in conductance due to the presence or absence of this circular disk 150, so that it is possible to prevent reduction of the evacuation speed due to the provision of the circular disk 150. Moreover, since the plate shaped mesh structure 153 is provided at right angles with respect to the flange surface so that its surface faces right beside, accordingly it is possible to make the open area ratio as seen from the inlet opening 21*a* as great as possible, and it is possible to suppress decrease of the evacuation speed. In other words, the baffle 15 of this embodiment is able reliably to capture the recoil particles, while suppressing reduction of the evacuation speed to the greatest possible extent.

Figure 7:
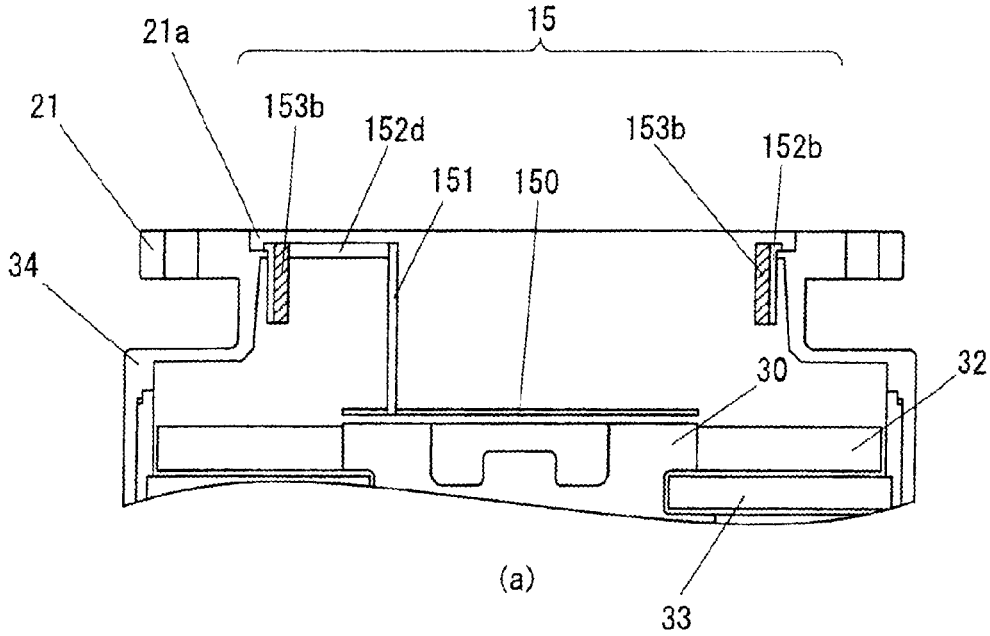
FIG. 7 is a figure showing variant embodiments.
Figure 7:
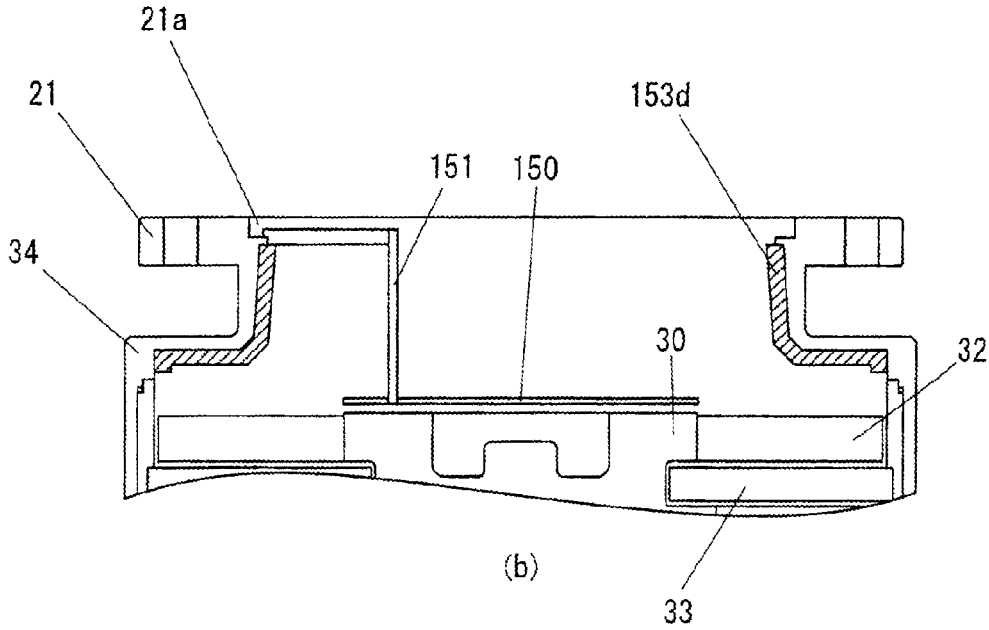

FIG. 7 is a figure showing variants of this embodiment. In a first variant embodiment shown in FIG. 7(*a*), by making the reduction of conductance due to the baffle 15 smaller, the structure gives more emphasis to the evacuation speed. For this, the inner ring 152*a* and the radially extending ribs 152*c* shown in FIG. 4, and the mesh structures 153*a* and 153*c* provided to them, are omitted. A plurality of support beams 152*d* are provided extending radially from the outer ring 152*b*, and the struts 151 are fixed to these support beams 152*d*.

Since, as shown in FIG. 5, the recoil particles that have been struck by the rotor 30 and that have bounced off it proceed in the outward peripheral direction, accordingly the probability that these recoil particles will directly get into the device side is extremely small. In other words, it is considered that the particles that flow in reverse to the side of the device are ones that have been reflected a number of times within the pump. Due to this, it is considered that the reduction in the particle capture ratio will be acceptable, even if the mesh structures 153*a* and 153*c* provided to the inner ring 152*a* and to the radially extending ribs 152*c* are omitted.

And, in a second variant embodiment shown in FIG. 7(*b*), instead of the outer ring 152*b* and the mesh structure 153*b* shown in FIG. 7(*a*), the mesh structure 153*d* is provided directly upon the inner circumferential surface of the pump casing 34. In this case as well, it is possible to suppress decrease of the evacuation speed to the maximum possible level.

Figure 8:
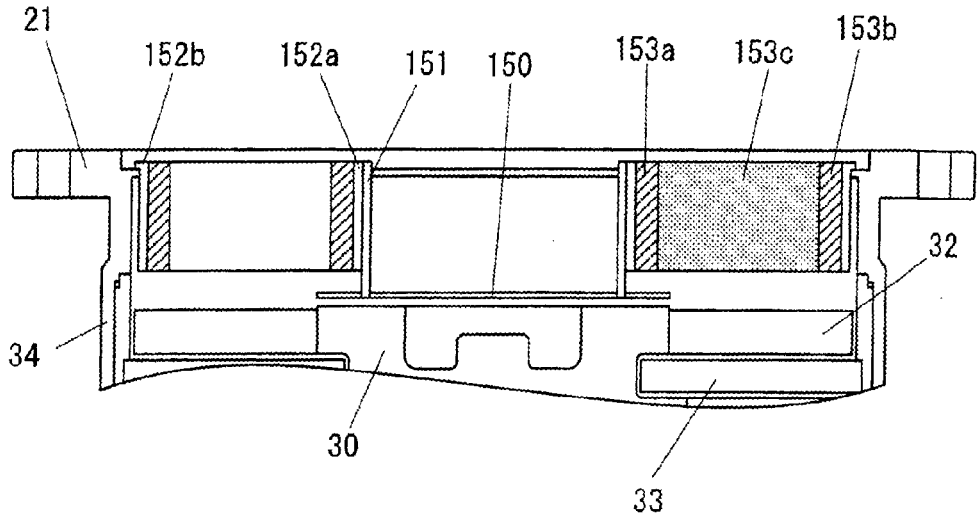
FIG. 8 is a figure showing the mesh structure 153 when the pump casing 34 is cylindrical.
Figure 8:
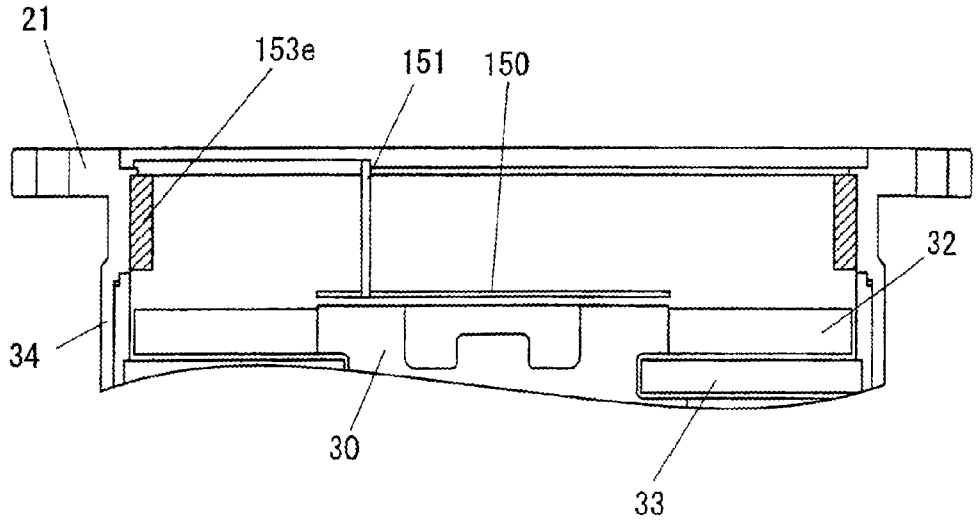

While, in the embodiments described above, the diameter of the pump casing 34 was reduced in the neighborhood of the flange so that it was necked there, in variant embodiments shown in FIG. 8, cases are shown in which the pump casing 34 is of a cylindrical shape is employed. FIG. 8(*a*) corresponds to FIG. 3, and FIG. 8(*b*) corresponds to FIG. 7(*b*). In the case of the structure shown in FIG. 8(*b*), while a mesh structure 153*e* is provided located upon the inner peripheral surfaces of the circular disk 150 and the pump casing, the construction is almost the same as when the outer ring 152*b* and the mesh structure 153*b* were provided, as in FIG. 7(*a*).

It should be understood that while, in the embodiments described above, the frame 152 of the baffle 15 was made in a ribbed construction, it would also be acceptable for it not to be a ribbed construction. Moreover, it would also be acceptable to arrange to reduce the influence of thermal radiation between the process chamber and the rotor 30 by reducing the thermal emission ratio of the surface of the circular disk 150.

—Second Embodiment—

Figure 9:
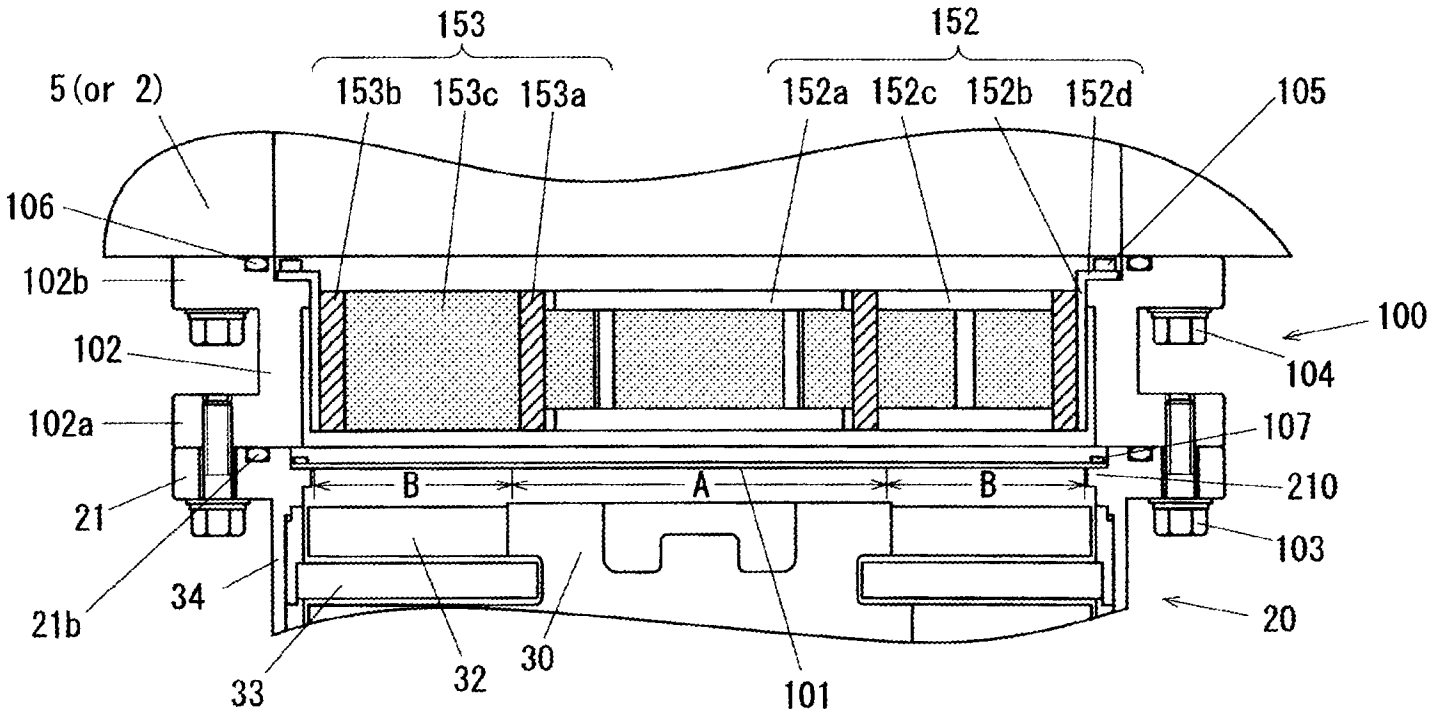
FIG. 9 is a figure showing a second embodiment.

FIG. 9 is a figure showing a second embodiment of the present invention. In the first embodiment described above, the baffle 15 for particle capture was provided within the pump casing 34 of the turbomolecular pump. However, all turbomolecular pumps are not limited to being built so that the baffle 15 as described above is fitted within the pump casing. Thus, in the second embodiment explained in the following, a particle capture unit will be explained that can be installed afterwards, as an addition, to a turbomolecular pump built with no baffle 15 being fitted within the pump casing.

FIG. 9 shows a particle capture unit 100 that is installed to a turbomolecular pump. This particle capture unit 100 includes a frame 152, a mesh structure 153, a casing 102, and a protective net 101. The frame 152 and the mesh structure 153 are similar to the frame 152 and the mesh structure 153 of the baffle 15 shown in FIG. 4. In other words, this particle capture unit 100 captures recoil particles that have been struck by the rotor 30 and have bounced off from it, and thus prevents reverse flow of the recoil particles from the side of the turbomolecular pump to the side of the device.

The frame 152 is fixed to the casing 102 by engaging fixing portions 152*h* thereof to the casing 102 by screws 105. And the mesh structure 153 is fitted to the frame 152. The casing 102 is provided with a flange 102*a* that is fixed to the flange 21 of the turbomolecular pump 10, and with a flange 102*b* that is fixed to the device side. For example, if the turbomolecular pump 10 is connected to a process chamber 2 via a gate valve 5 as shown in FIG. 2, then the flange 102*b* on the device side would be connected to the gate valve 5. And, if the turbomolecular pump 10 is connected directly to the process chamber 2, then the flange 102*b* on the device side would be connected to the process chamber 2. In other words, this particle capture unit 100 is provided so as to be interposed between the turbomolecular pump 10 and the device side.

A seal member 106 (an O-ring) is installed to the flange 102*b*. When the flange 102*b* is engaged to the gate valve 5 with bolts 104, then the gap between the gate valve 5 and the flange 102*b* is sealed by this seal member 106. On the other hand, on the side of the flange 102*a*, a seal member 21*b* (an O-ring) is installed to the flange 21 of the turbomolecular pump 10. When the flange 102*a* and the flange 21 are engaged together with bolts 103, then the gap between the flange 102*a* and the flange 21 is sealed by this seal member 21*b*.

Figure 10:
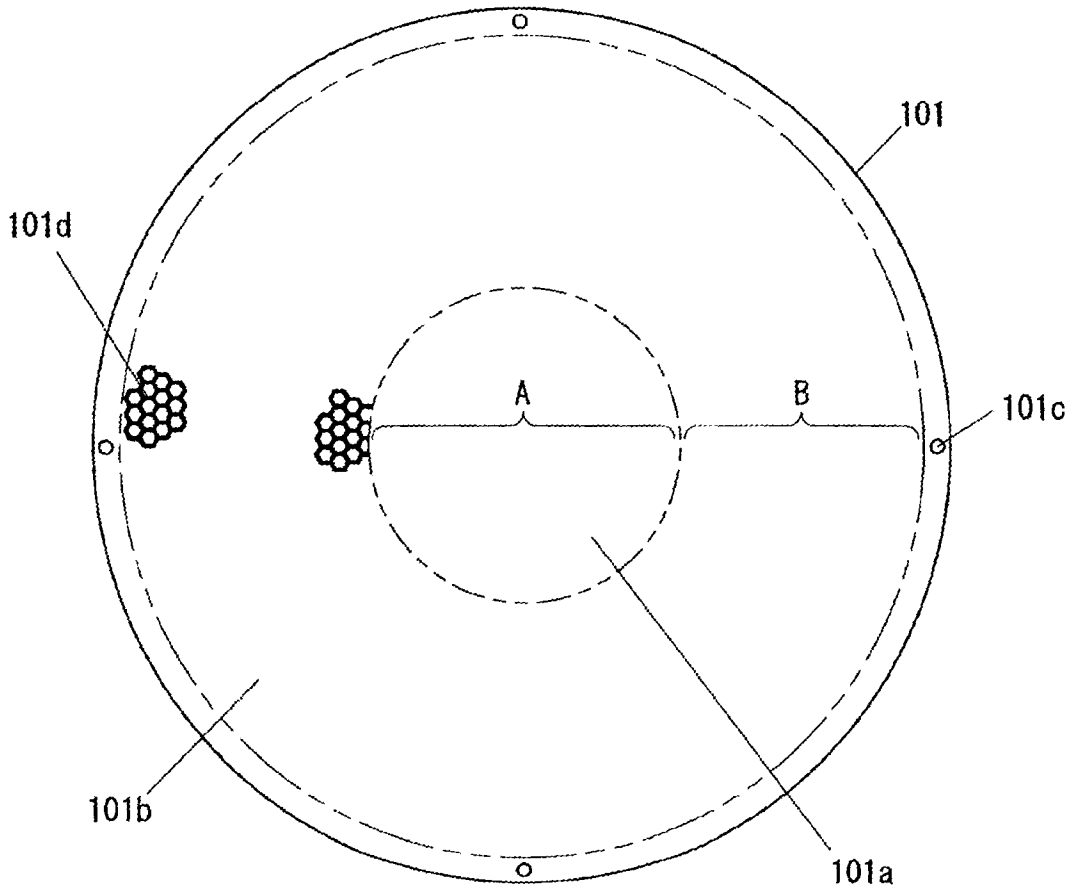
FIG. 10 is a plan view showing a protective net 101.

FIG. 10 is a plan view of the protective net 101. This protective net 101 is made from a thin plate such as stainless steel or the like. The protective net 101 includes a circular region 101*a* shown by the reference symbol A and a circular annular net region 101*b* shown by the reference symbol B. A plurality of apertures 101*d* are formed in the net region 101*b* by etching. In the example shown in FIG. 10 the apertures 101*d* are shaped as regular hexagons and are arranged in a honeycomb configuration. The circular region 101*a* is made by performing masking of a circle during etching. And holes 101*c* for screws are formed at portions around the protective mesh 101.

Figure 11:
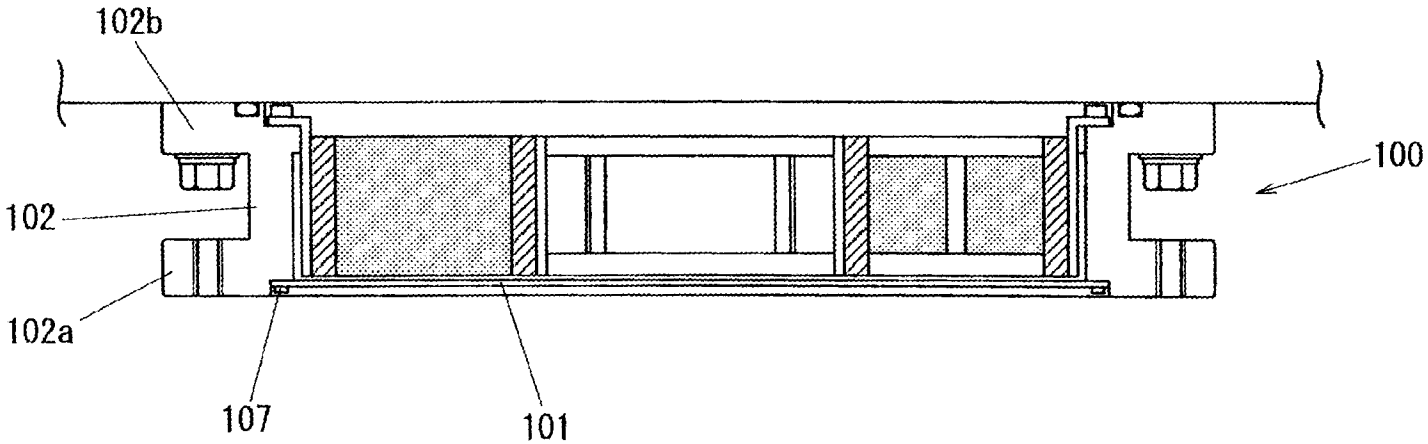
FIG. 11 is a figure showing the structure of a particle capture unit 100 when the protective net 101 is provided to the turbomolecular pump side of the casing 102.

While, in the case of the structure shown in FIG. 9, the protective mesh 101 is fixed to the circular portion 210 of the flange 21 of the turbomolecular pump 10 by the screws 107, it would also be acceptable for it simply to be received in the clearance between the flange 102*a* of the casing 102 and the ring portion 210. Moreover it would also be acceptable to fix it with screws to the flange 102*a* on the turbomolecular side of the casing 102, as shown in FIG. 11, or to fix it directly to the frame 152.

The diameter of the circular region 101*a* of the protective mesh 101 is set to be less than or equal to the diametrical dimension of the fixing root portions of the rotating blades 32 of the rotor 30, so that the net region 101*b* is opposed by the rotating blades 32. The turbomolecular pump 10 evacuates gas that has passed through the net region 101*b*. The net region 101*b* is provided for preventing foreign matter (such as broken pieces of wafers, portions of components from the device side, or the like) from falling down within the turbomolecular pump and damaging the rotating blades 32 or the fixed blades 33. Moreover, the circular region 101*a* of the protective net 101 has a function similar to that of the circular disk 150 described above, and prevents particles from the device side from falling down upon the upper surface of the rotor 30.

It should be understood that while, with the protective net 101 described above, the circular region 101*a* is formed by performing masking of a circle during the process of etching the thin plate material, it would also be acceptable to arrange to attach a circular disk to the central portion after the entire element has been etching processed into the form of a net. Moreover, when a net made by interlacing metallic wires is used as the protective net 101 as well, the protective net 101 is formed by attaching a circular disk to its central portion.

It should be understood that, in the example shown in FIG. 9, a structure was employed in which the protective net 101 was included in the particle capture unit 100. However, in the case of a turbomolecular pump that includes its own dedicated protective net, it would also be acceptable to build the particle capture unit 100 as a component from which the protective net 101 is omitted.

Figure 12:
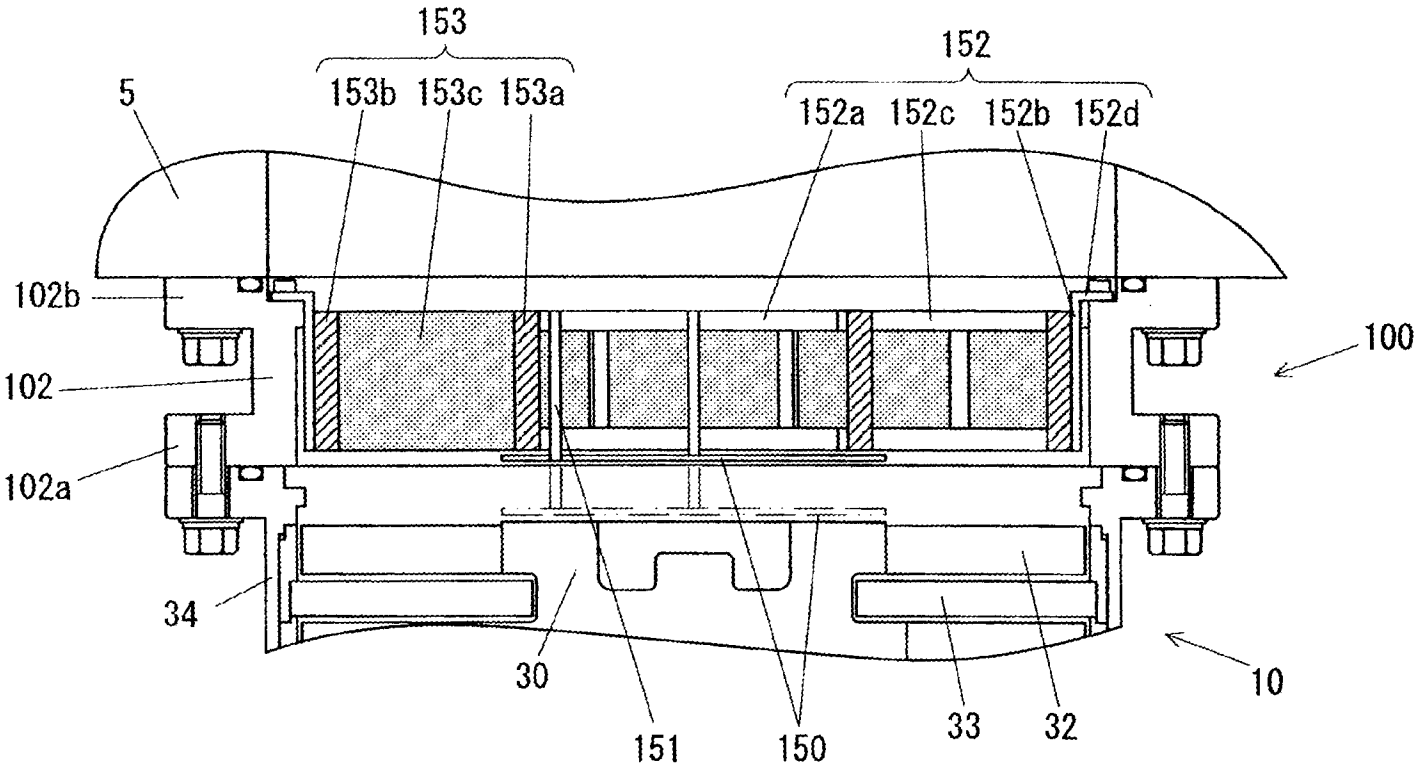
FIG. 12 is a figure showing a variant embodiment of the particle capture unit 100.

FIG. 12 is a figure showing a variant embodiment of the particle capture unit 100. With the particle capture unit 100 shown in FIG. 12, instead of the protective net 101 of FIG. 9, the circular disk 150 shown in FIG. 4 is provided. This circular disk 150 is fixed to the inner ring 152*a* by struts 151. The position of the circular disk 150 in the axial direction could be within the casing 102 as shown by the solid lines; or it would also be acceptable to arrange for a configuration to be provided in which the struts 151 are elongated towards the pump side as shown by the double dotted broken lines, so that the circular disk is located near the rotor 30 and above it.

Figure 13:
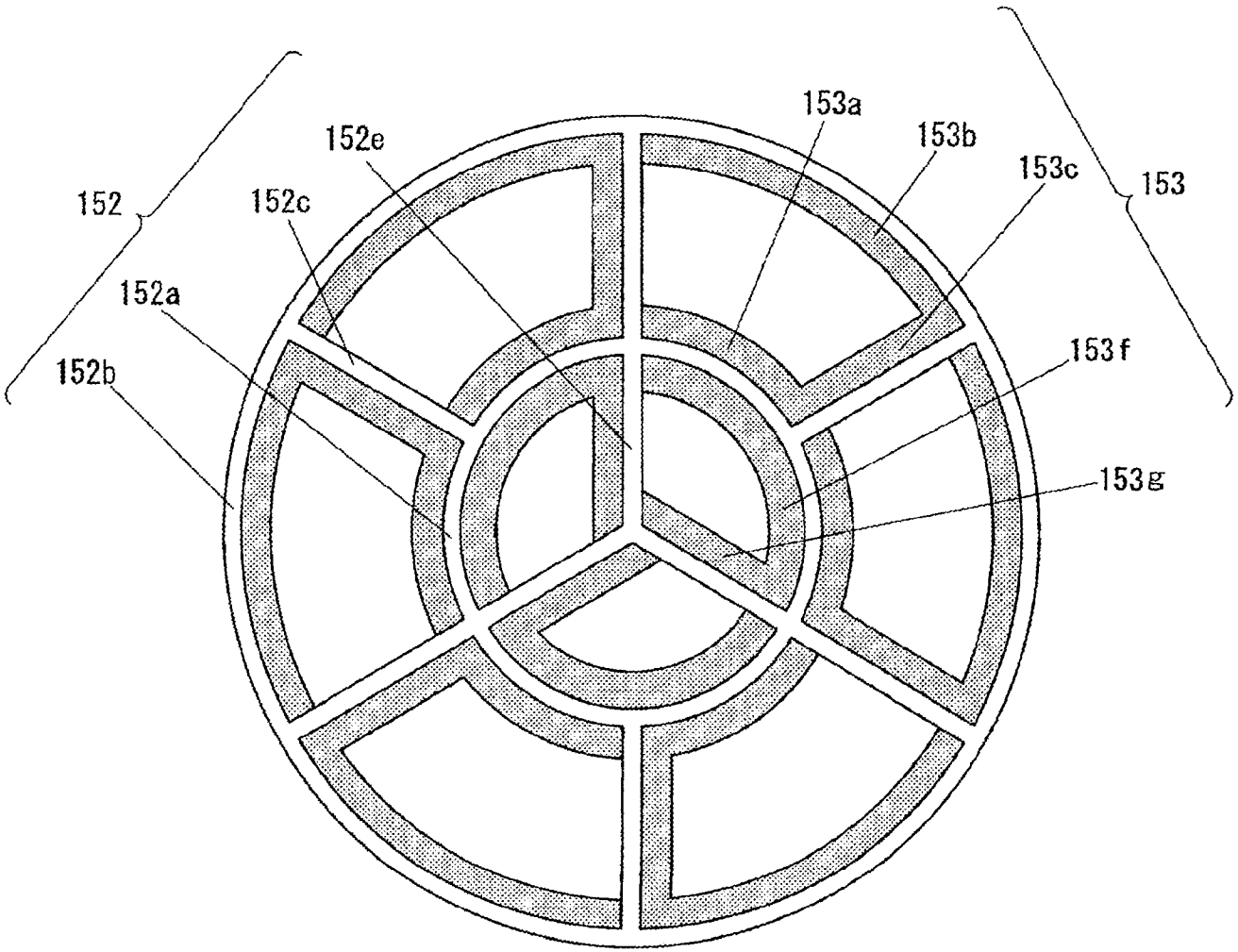
FIG. 13 is a figure showing a variant embodiment of the frame 152 and the mesh structure 153.

FIG. 13 shows variant embodiments of the frame 152 and the mesh structure 153 received within the casing 102. This frame 152 is also provided with radially extending ribs 152*e* radially inward of the inner ring 152*a*. And mesh structures

153*f* and 153*g* are attached to the inner peripheral surface of the inner ring 152*a* and to the radially extending ribs 152*e*. By providing the mesh structures 153*f* and 153*g* positioned to oppose the upper surface of the rotor 30 in this manner, particles that are struck by the upper surface of the rotor and bounce off it are captured by the mesh structures 153*f* and 153*g*, so that it is possible to prevent reverse flow to the device side, even though the circular disk 150 and the circular region 101*a* are omitted. If the circular region 101*a* in FIG. 10 is omitted, then the apertures 101*d* are also formed in the region shown by the reference symbol A. Moreover, by employing a structure as shown in FIG. 13, it is possible to enhance the evacuation efficiency for gas molecules that are incident upon the interior side of the inner ring 152*a*, so that it is possible to suppress reduction of efficiency of the evacuation speed.

By providing a particle capture unit 100 such as shown in this second embodiment, it is possible to implement countermeasures against recoil particles even for a turbomolecular pump for which no recoil particle countermeasures are implemented, without exchanging the pump. Moreover, by forming the circular disk that prevents particles falling down upon the upper surface of the rotor as one element with the protective net for preventing mixing in of foreign matter, it is possible to restrain increase of the number of components, so that suppression of elevation of the cost may be anticipated. It should be understood that it would also be possible to use the protective net 101 shown in FIG. 10 in the first embodiment as well, instead of the circular disk 150.

While various embodiments and variant embodiments have been explained in the above description, the present invention is not to be considered as being limited to the details thereof. Other modes that are considered to fall within the range of the technical concept of the present invention are also included within the scope of the present invention.

The contents of the disclosures of the following applications, on which priority is claimed, are hereby incorporated herein by reference:

Japanese Patent Application 2009-41, 318 (tiled on 24 Feb. 2009); and

Japanese Patent Application 2009-251, 801 (filed on 2 Nov. 2009).

The invention claimed is:

1. A turbomolecular pump, comprising:

a rotor formed with rotating blades in a plurality of stages, and rotating at high speed;

a plurality of fixed blades arranged along axial direction of the pump so as to alternate with respect to the rotating blades;

a pump housing containing the rotating blades and the fixed blades, and formed with an inlet opening;

a circular disk, provided close to the rotor on the inlet opening side, and arranged so as to oppose a surface on the rotor more radially inward than a root portion of the rotating blades;

a cylindrical mesh structure, disposed between the inlet opening and the rotor, and made by interlacing fine wires; and a plurality of plate shaped mesh structures disposed so as to extend radially with respect to the cylindrical mesh structure, and provided perpendicularly to a plane of the pump inlet opening, wherein particles that are struck by the rotor and bounce off it are captured internally in the cylindrical mesh structure.

2. A turbomolecular pump, comprising:

a rotor formed with rotating blades in a plurality of stages, and rotating at high speed;

a plurality of fixed blades arranged along axial direction of the pump so as to alternate with respect to the rotating blades;

a pump housing containing the rotating blades and the fixed blades, and formed with an inlet opening;

a circular disk, provided close to the rotor on the inlet opening side, and arranged so as to oppose a surface on the rotor more radially inward than a root portion of the rotating blades; and a mesh structure provided along the pump housing inner wall and having a laminated construction comprising a plurality of layers each being interlaced with fine wires.

3. A particle trap for a turbomolecular pump, comprising:

a casing that comprises a first flange connected to a flange of an inlet opening of the turbomolecular pump and a second flange that is connected to a flange of an outlet opening of a vacuum device;

a cylindrical mesh structure, disposed in the casing interior, and made by interlacing fine wires so as to capture in its interior particles that have been struck by a rotor of the turbomolecular pump and have bounced off it; and a plurality of plate shaped mesh structures disposed so as to extend radially with respect to the cylindrical mesh structure, and provided along axial direction of the first and second flanges.

4. A turbomolecular pump, comprising:

a rotor formed with rotating blades in a plurality of stages, and rotating at high speed;

a plurality of fixed blades arranged along axial direction of the pump so as to alternate with respect to the rotating blades;

a pump housing containing the rotating blades and the fixed blades, and formed with an inlet opening;

a circular disk, provided close to the rotor on the inlet opening side, and arranged so as to oppose a surface on the rotor more radially inward than a root portion of the rotating blades; and a cylindrical mesh structure disposed between the inlet opening and the rotor, the cylindrical mesh structure having a laminated construction comprising a plurality of layers each being interlaced with fine wires, wherein particles that are struck by the rotor and bounce off it are captured internally in the cylindrical mesh structure.

5. A particle trap for a turbomolecular pump, comprising:

a casing that comprises a first flange connected to a flange of an inlet opening of the turbomolecular pump and a second flange that is connected to a flange of an outlet opening of a vacuum device; and a cylindrical mesh structure disposed in the casing interior and having a laminated construction comprising a plurality of layers each being interlaced with fine wires, wherein particles that are struck by the rotor and bounce off it are captured internally in the cylindrical mesh structure.

6. The turbomolecular pump according to claim 1 or claim 4, comprising a protective net that prevents ingress of foreign matter into the pump housing via the inlet opening, including the circular disk, and a net region that is provided to the protective net so as to surround the circular disk and in which a plurality of apertures are formed.

7. The turbomolecular pump according to any one of claims 1, 2 and 4, wherein the fine wires are made from stainless steel.

8. The turbomolecular pump according to any one of Claims 1, 2 and 4, wherein the fine wires are made from alumina-silica fiber containing 6 to 10% silica.

9. The particle trap for a turbomolecular pump according claim 3 or claim 5, further comprising a circular disk that is disposed near the first flange so as to face the rotor upper surface of the turbomolecular pump, and whose diametrical dimension is less than or equal to a diameter of a root portion of rotating blades of the rotor of the turbomolecular pump.

10. The particle trap for a turbomolecular pump according to claim 3, further comprising a protective net having a circular region whose diametrical dimension is less than or equal to the diameter of a root portion of rotating blades of the rotor of the turbomolecular pump and a net region that is provided so as to surround a periphery of the circular region and in which a plurality of apertures are formed, and that prevents ingress of foreign matter into the turbomolecular pump via the flange of the inlet opening flange.

11. The particle trap for a turbomolecular pump according to claim 3 or claim 5, wherein the wires are made from stainless steel.

12. The particle trap for a turbomolecular pump according to claim 3 or claim 5, wherein the fine wires are made from alumina-silica fiber containing 6 to 10% silica.

* * * * *